US005511294A

United States Patent [19]

Fehrer

[11] Patent Number: 5,511,294

[45] Date of Patent: Apr. 30, 1996

[54] APPARATUS FOR NEEDLING A NONWOVEN WEB

[76] Inventor: Ernst Fehrer, Auf der Gugl 28, A-4020 Linz, Austria

[21] Appl. No.: 399,731

[22] Filed: Mar. 7, 1995

[30] Foreign Application Priority Data

Mar. 23, 1994 [AT] Austria ..... 610/94

[51] Int. Cl.[6] ..... D04H 18/00

[52] U.S. Cl. ..... 28/113; 28/107

[58] Field of Search ..... 28/107, 110, 111, 28/113, 114

[56] References Cited

U.S. PATENT DOCUMENTS

| | | | |
|---|---|---|---|
| 3,916,494 | 11/1975 | Konig | 28/107 |
| 4,241,479 | 12/1980 | Dilo | 28/107 |
| 4,891,870 | 1/1990 | Muller | 28/107 |

FOREIGN PATENT DOCUMENTS 249392 1/1966 Austria .

*Primary Examiner*—John J. Calvert
*Attorney, Agent, or Firm*—Collard & Roe

[57] ABSTRACT

An apparatus is described which serves to needle a nonwoven web and comprises a slider crank mechanism, which is pivoted to a rocker and serves to actuate at least one needle board, which is secured to the rocker. The apparatus also comprises a web guide consisting of a web support, which is opposite to the needle board, and a stripper, which extends between the web support and the needle board. To permit an influence to be exerted on the result of the needling operation it is proposed that the mean inclination of the paths on which the needles of the needle board penetrate the nonwoven web relative to the direction of travel of the nonwoven web is adjustable.

3 Claims, 2 Drawing Sheets

APPARATUS FOR NEEDLING A NONWOVEN WEB

BACKGROUND OF THE INVENTION

1. Field of the Invention

This invention relates to an apparatus for needling a nonwoven web, comprising a slider crank mechanism, which is pivoted to a rocker and serves to actuate at least one needle board, which is secured to the rocker, and a web guide, which consists of a web support, which is opposite to the needle board, and a stripper, which extends between the web support and the needle board.

2. Description of the Prior Art

Needle boards actuated by slider crank mechanisms are driven either by push rods, which are slidably mounted in slideways, or by means of rockers, which carry the needle boards and are pivoted to the slider crank mechanism (Austrian Patent Specification 249,392). The use of a rocker to guide the needle board affords the advantage that the design is simpler because it is no longer necessary to provide push rods and associated slideways between the connecting rods of the slider crank mechanism and the needle beam which carries the needle board. Besides, the needling effected by a rocker-actuated needle board may sometimes differ from the needling effected by a needle board which is reciprocated along a straight path.

SUMMARY OF THE INVENTION

For this reason it is an object of the invention to provide an apparatus which serves to needle a nonwoven web and is of the kind described first hereinbefore and is so designed that different needling effects can be achieved because the needle board can be moved along different paths relative to the direction of travel of the nonwoven web.

This object is accomplished in accordance with the invention in that the mean inclination of the paths on which the needles penetrate the nonwoven web relative to the direction of travel of the nonwoven web in said web guide is adjustable.

The invention is based on the recognition that the needles of a needle board which is actuated by a rocker will penetrate the nonwoven web along an arc of a circle so that the movement of the penetrating needles comprises an additional component in the direction of travel of the nonwoven web and, as distinguished from a penetration of the needles along a straight path, this will result in a felting of the nonwoven web also in its direction of travel. The effect of that component of motion on the result of the needling operation will mainly be determined by the mean inclination of the paths on which the needles penetrate the nonwoven web and the direction of travel of the nonwoven web and may be adapted to given requirements and operating conditions by an adjustment of the mean inclination of the paths on which the needles penetrate the web.

For this reason the mean inclination of the paths on which the needles penetrate the nonwoven web may be adjustable to at least two inclinations with which the needles are operable to penetrate the nonwoven web with a component of motion in said direction of travel.

Either of two basic designs may be adapted for the means for adjusting the mean inclination of the paths on which the needles penetrate the web. The pivotal axis of the rocker may be displaceable generally in the direction in which the needle board is reciprocated or the web guide may be adjusted about a pivotal axis, which is parallel to the pivotal axis of the rocker and disposed in an intermediate portion of the web guide. Although the same position of the web guide relative to the pivotal axis of the rocker can be achieved in both cases, a simpler design will be permited in general if the pivotal axis of the rocker is displaced. The larger the distance from the pivotal axis of the rocker to the plane of travel defined by the guide between the web support and the stripper, the smaller will be the inclination of the path on which the needles penetrate the nonwoven web and the more highly will the nonwoven web be felted in its direction of travel. Besides, needles penetrating the nonwoven web with a component of motion in the direction of travel of the nonwoven web will not so strongly adversely affect the travel of the web than needles which penetrate the nonwoven web at right angles thereto so that advantages will be obtained also in that respect.

DETAILED DESCRIPTION OF THE PREFERRED EMBODIMENTS

Figure 1:
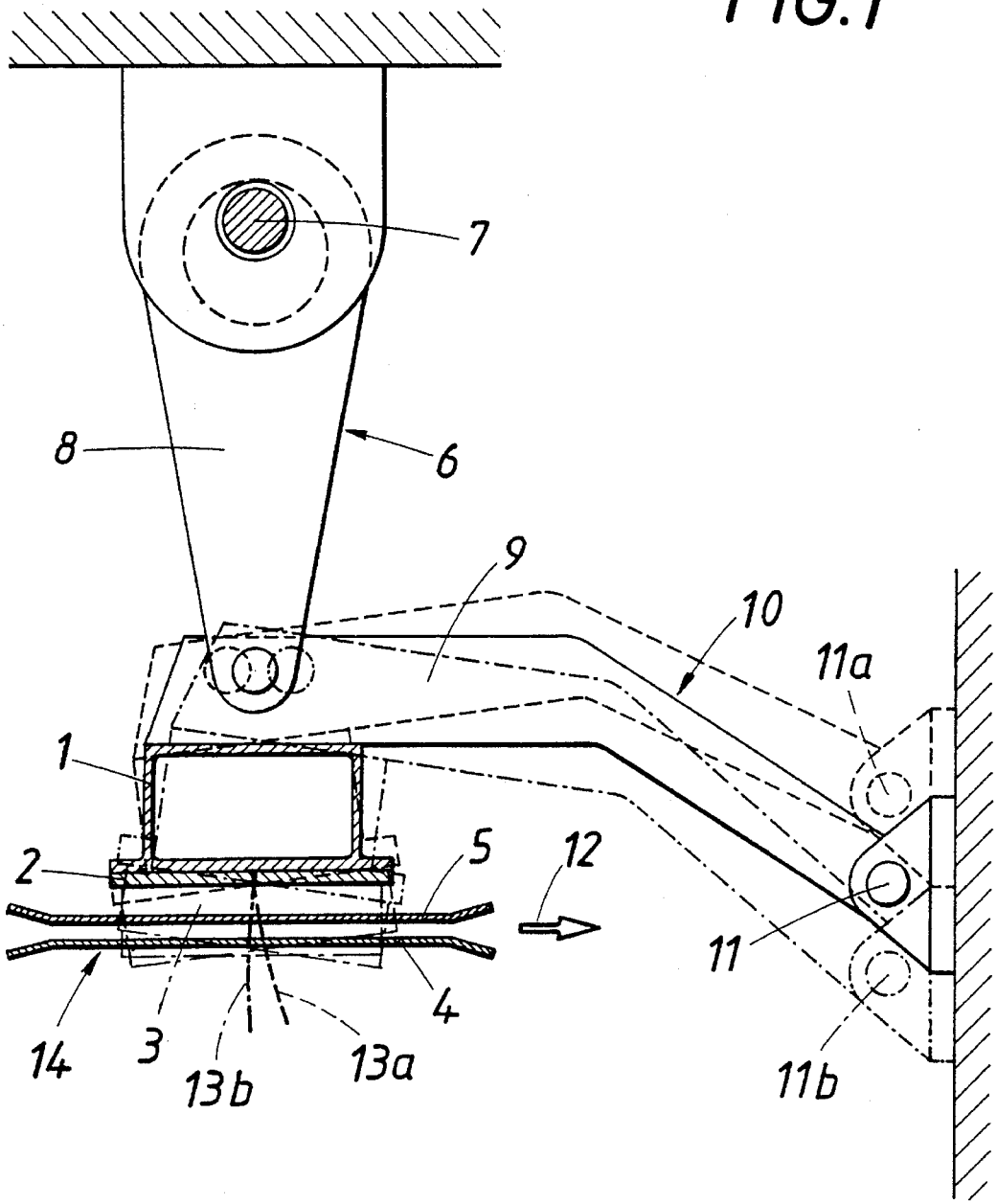
FIG. 1 is a schematic side elevation showing an apparatus in accordance with the invention for needling a nonwoven web. In that apparatus the rocker carrying the needle board has a pivotal axis which is adjustable generally in the direction in which the needle board is reciprocated.

Illustrative embodiments of the invention are shown on the drawing.

The illustrated apparatus comprises at least one needle board 2, which is held in a needle beam 1 and is provided with needles 3, which are indicated in phantom and are operable to penetrate a nonwoven web, which is guided between a web support 4 and a stripper 5. To permit a penetration by the needles, the web support 4 and the stripper 5 consist of perforated plates. The needle board 2 is actuated by a slider crank mechanism 6, which consists in the usual manner of a crankshaft or eccentric shaft 7 and at least two parallel connecting rods 8, which are rotatably mounted on said crankshaft or eccentric shaft 7. The connecting rods 8 are pivoted to parallel arms 9 of a rocker 10, which has a pivotal axis 11. Because the needle beam 1 is secured to the rocker 10, the rocker 10 which is actuated by the slider crank mechanism 6 moves the needle board 2 along an arc of a circle about the pivotal axis 11. If two or more needle boards are provided in a row which is transverse to the direction of travel 12 of the web, each needle board will similarly be actuated by the slider crank mechanism via a separate rocker.

Because the needle board moves along an arc of a circle, the usual conventional straight needles may be replaced by needles 3 having a working portion which is curved in a plane that is at right angles to the pivotal axis 11 of the rocker 10 along an arc of a circle which is centered at least approximately adjacent to the pivotal axis 11 of the rocker 10 so that the working portion of the needles 3 at least approximately conforms to the passage which is formed in the nonwoven web by the penetrating needle.

Because the needles 3 penetrate the nonwoven web along an arc of a circle, the paths on which the needles 3 penetrate the web have a mean inclination relative to the direction of travel 12 in the web guide 14. To permit said inclination of the paths of penetration to be adjusted and to be utilized for achieving a predetermined effect of the needling operation, the pivotal axis 11 of the rocker 10 of the embodiment shown in FIG. 1 is mounted to be adjustable generally in the direction in which the needle board 2 is reciprocated. When the pivotal axis of the rocker is in its uppermost position, in which the pivot is shown by a broken line and designated 11*a*, the needles 3 will penetrate the nonwoven web along a mean path 13*a*. When the pivotal axis of the rocker is in its lowermost position, in which the pivot is indicated by a dash-dot line and designated 11*b*, the needles 3 will penetrate the nonwoven web a mean path 13*b*. Said mean penetrating paths 13*a* and 13*b* have different inclinations relative to the web guide 14, which consists of the web support 4 and the stripper 5, and for this reason result in needling operations which produce different effects, which can be selected as desired by an adjustment of the pivotal axis of the rocker.

Figure 2:
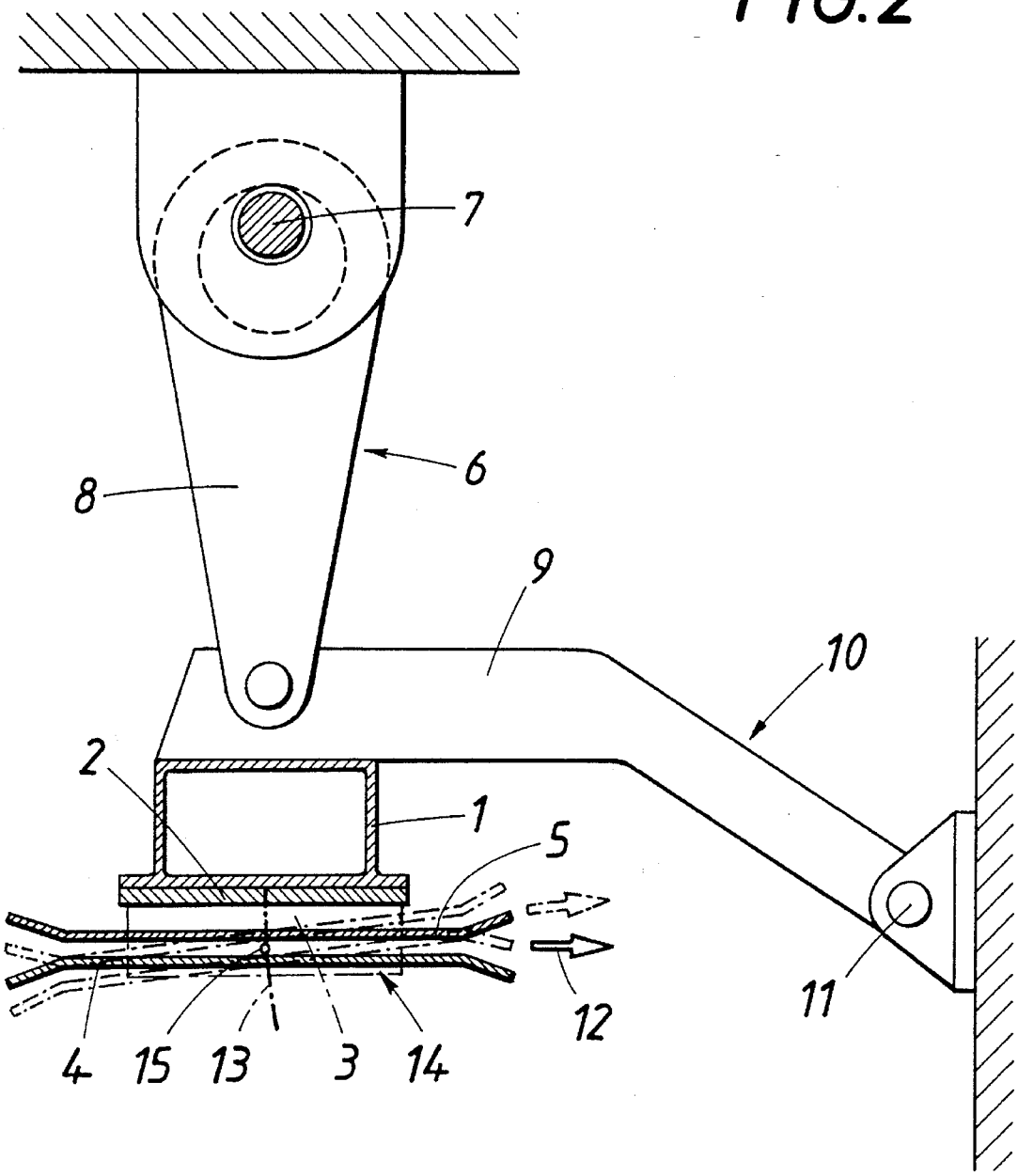
FIG. 2 is a view that is similar to FIG. 1 and shows a modified apparatus in accordance with the invention, in which the web guide is pivotally adjustable.

Different means for adjusting the mean inclination of the paths on which the needles 3 penetrate the nonwoven web are indicated in FIG. 2. In that illustrative embodiment the pivotal axis 11 of the rocker 10 is not displaceable but is stationary and the web guide 12 is pivotally movable about a pivotal axis 15, which is disposed in an intermediate portion of the web guide 14 and is parallel to the pivotal axis 11 of the rocker 10. By that adjustment the inclination of a mean path 13 of the penetrating needles relative to the direction of travel determined for the nonwoven web by the web guide is also changed as is indicated by the web guide represented by dash-dot lines in a pivotally adjusted position.

From FIGS. 1 and 2 it is also apparent that an adjustment of the pivotal axis of the rocker or a pivotal adjustment of the web guide 14 will result also in a change of the depth of penetration of the needles in dependence on their distance from the pivotal axis 11 of the rocker 10 and that this will also influence the result of the needling operation and can properly be utilized.

I claim:

1. In an apparatus for needling a nonwoven web comprising a needle board carrying a multiplicity of needles, a web guide consisting of a web support, which is opposite to said needle board, and a stripper extending between said web support and said needle board, said web guide being adapted to guide said nonwoven web in a direction of travel, a rocker having a pivotal axis and secured to said needle board, and a slider crank mechanism pivoted to said rocker and operable to reciprocate said needle board in a predetermined direction by means of said rocker, whereby said needles are operable to penetrate said nonwoven web on said web support along paths having a mean inclination relative to said direction of travel of said nonwoven web in said web guide, the improvement comprising means for adjusting said mean inclination of said paths of said needles relative to said direction of travel.

2. In an apparatus for needling a nonwoven web comprising a needle board carrying a multiplicity of needles, a web guide consisting of a web support, which is opposite to said needle board, and a stripper extending between said web support and said needle board, said web guide being adapted to guide said nonwoven web in a direction of travel, a rocker having a pivotal axis and secured to said needle board, and a slider crank mechanism pivoted to said rocker and operable to reciprocate said needle board in a predetermined direction by means of said rocker, whereby said needles are operable to penetrate said nonwoven web on said web support along paths having a mean inclination relative to said direction of travel of said nonwoven web in said web guide, the improvement comprising means for adjusting the pivotal axis of said rocker in said predetermined direction whereby said mean inclination of the paths of said needles is adjusted relative to the direction of travel of said nonwoven web.

3. In an apparatus for needling a nonwoven web comprising a needle board carrying a multiplicity of needles, a web guide consisting of a web support, which is opposite to said needle board, and a stripper extending between said web support and said needle board, said web guide being adapted to guide said nonwoven web in a direction of travel, a rocker having a pivotal axis and secured to said needle board, and a slider crank mechanism pivoted to said rocker and operable to reciprocate said needle board in a predetermined direction by means of said rocker, whereby said needles are operable to penetrate said nonwoven web on said web support along paths having a mean inclination relative to said direction of travel of said nonwoven web in said web guide, the improvement comprising a pivotal axis disposed in an intermediate portion of said web guide, the pivotal axis of said web guide extending parallel to the pivotal axis of said rocker and the web guide being pivotal thereon to adjust said mean inclination of the paths of said needles relative to the direction of travel of said nonwoven web.

* * * * *